US008321068B2

(12) United States Patent
Sacle et al.

(10) Patent No.: US 8,321,068 B2
(45) Date of Patent: Nov. 27, 2012

(54) METHOD OF PLOTTING A PORTION OF TRAJECTORY OF AN AIRCRAFT COMPRISING A CIRCULAR ARC OF CONSTANT RADIUS

(75) Inventors: Jérôme Sacle, Toulouse (FR); Manuel Gutierrez-Castaneda, Toulouse (FR)

(73) Assignee: Thales, Neuilly sur Seine (FR)

( * ) Notice: Subject to any disclaimer, the term of this patent is extended or adjusted under 35 U.S.C. 154(b) by 1048 days.

(21) Appl. No.: 12/121,086

(22) Filed: May 15, 2008

(65) Prior Publication Data

US 2009/0082955 A1 Mar. 26, 2009

(30) Foreign Application Priority Data

May 15, 2007 (FR) ..... 07 03480

(51) Int. Cl.
*G05D 1/00* (2006.01)

(52) U.S. Cl. ..... 701/3

(58) Field of Classification Search ..... 701/3, 206; 244/189

See application file for complete search history.

(56) References Cited

U.S. PATENT DOCUMENTS

| | | | |
|---|---|---|---|
| 3,994,456 A | 11/1976 | Post et al. | |
| 5,646,854 A | 7/1997 | Bevan | |
| 2005/0012642 A1 | 1/2005 | Sale | |
| 2006/0142904 A1 * | 6/2006 | Caillaud et al. | 701/3 |
| 2007/0050101 A1 | 3/2007 | Sacle et al. | |
| 2008/0162092 A1 | 7/2008 | Coulmeau et al. | |

FOREIGN PATENT DOCUMENTS

| | | |
|---|---|---|
| EP | 0722132 | 7/1996 |
| WO | WO0150087 | 7/2001 |

OTHER PUBLICATIONS

U.S. Appl. No. 12/066,499, filed May 28, 2008, Sacle et al. (Not Yet Published).
U.S. Appl. No. 12/041,731, filed Mar. 4, 2008, Sacle et al. (Not Yet Published).
U.S. Appl. No. 12/113,255, filed May 1, 2008, Sacle et al. (Not Yet Published).
U.S. Appl. No. 12/129,212, filed May 29, 2008, Sacle et al. (Not Yet Published).
U.S. Appl. No. 12/208,461, filed Sep. 11, 2008, Coulmeau et al. (Not Yet Published).

* cited by examiner

*Primary Examiner* — John Pauls
(74) *Attorney, Agent, or Firm* — Lowe Hauptman Ham & Berner, LLP

(57) ABSTRACT

A method is disclosed for plotting a trajectory portion (6, 6"), using flight management means of an aircraft, and linking a known position (7) of the aircraft to a point in space (4), denoted the "exit point". A circular arc is defined, the coordinates of whose centre (1) are known, comprising two ends (3, 4) of known coordinates, one end of which is the exit point (4). The position of a transition point (5) is determined which is situated on the arc. The trajectory (6, 6") by the flight management means of the aircraft is automatically plotted. The trajectory is successively linking the known position (7) of the aircraft, and the transition point (5) and the exit point (4).

5 Claims, 2 Drawing Sheets

METHOD OF PLOTTING A PORTION OF TRAJECTORY OF AN AIRCRAFT COMPRISING A CIRCULAR ARC OF CONSTANT RADIUS

RELATED APPLICATIONS

The present application is based on, and claims priority from, French Application Number 07 03480, filed May 15, 2007, the disclosure of which is hereby incorporated by reference herein in its entirety.

FIELD OF THE INVENTION

The present invention relates to the field of the trajectories of an aircraft that are not predefined by flight management such as an FMS, the acronym standing for "flight management system". It relates, more particularly, to the creation of an AF leg, meaning "Arc to Fix", that is to say a trajectory portion forming a circular arc. It deals with the generation of a flight plan associated with the AF leg created and it relates to the insertion of the aircraft into the AF leg.

BACKGROUND OF THE INVENTION

Currently, certain RF legs, meaning: "constant radius between two fixes" and certain AF legs (Arc to a fix) are present in the navigation database of certain aircraft, notably in the majority of Airbus aircraft.

The AF and RF legs correspond to substantially circular portions of trajectory which form circular arcs. They are generally included in a flight plan of an aircraft by knowing the entry and exit points of the trajectory portions to be flown. According to the types of legs, they can be defined for example by a point corresponding to the centre of a circle, the point being charted in terms of latitude and longitude with respect to a known aerial beacon, and by two points situated at the ends of the arc, these are an entry point and an exit point of the trajectory portion corresponding to the circular arc.

The AF and RF legs can be included in a flight plan of the FMS when inserting a procedure corresponding to a departure or arrival of the aircraft for example. According to the beacons, the databases and the air routes, the RF and AF legs are generally predefined in the FMS. In such a case, it is simple with the aid of the FMS to fly certain portions corresponding to these legs in an automatic manner.

On the other hand, in a manner not planned in the flight plan of an aircraft's FMS, it may happen that in the terminal phase of a mission, air traffic control gives the aircraft presets to fly arcs at a constant distance with respect to a given point. In this case, this preset is often de-correlated from a terminal procedure existing in the navigation database and the arc does not exist in this database.

This may for example involve a request from air traffic control to an aircraft, outside of a defined procedure, to fly an arc around an aerial beacon, also called a DME arc in aeronautical terminology. This procedure may be necessary to allow an aircraft to align itself on the appropriate approach axis so as to start a final approach.

Moreover, this type of procedure can be undertaken on the initiative of the pilot who wishes to embark on an approach procedure. The latter case usually corresponds to military or general aviation flights operating on small aerodromes.

Currently, when the crew wishes to fly an arc corresponding to an AF or RF leg that is not planned by the FMS, two solutions are possible.

In a first case, the crew must create a series of waypoints of the flight plan that one wishes to fly. Waypoints, in aeronautical terminology, are points defined in the navigation database of the aircraft. These waypoints are created one by one up to the construction of a circular arc. This solution remains arduous since it is performed manually, moreover it is approximate.

In a second case the crew can use functions of the FMS making it possible to plot circular arcs but these functions are not intended for planning portions of a flight plan. The latter solution presents the disadvantage of having to fly the trajectory manually, trying to follow as closely as possible the circular arc forming the trajectory.

SUMMARY OF THE INVENTION

The invention proposes, by simple input of certain parameters performed by the crew by way of the FMS, to automatically plot a portion of the flight plan comprising a circular arc, denoted leg, the portion comprising at least one entry point and one exit point. Notably, the arcs created will be defined with constant arc thereby making it possible to simplify input and generation of the portion to be flown. The FMS then makes it possible to fly, automatically, this portion connecting a position of the aircraft to a flight plan to be joined.

The invention has the advantage of making it possible with the aid of the FMS to plan and to fly non-predefined trajectory portions comprising a circular arc, the trajectory portion comprising points not in the navigation database and which are not insertable manually into a flight plan when the latter is defined in advance.

An aim of the invention is notably to alleviate the aforesaid drawbacks. For this purpose, the subject of the invention is a method of plotting a trajectory portion, using flight management means of an aircraft, linking a known position of the aircraft to a point in space, denoted the "exit point", characterized in that it comprises:

- the definition of a circular arc, the coordinates of whose centre are known, comprising two ends of known coordinates, one end of which is the exit point;
- the determination of the position of a transition point situated on the arc;
- the automatic plotting of the trajectory by the flight management means of the aircraft, said trajectory successively linking the known position of the aircraft, the transition point and the exit point.

Advantageously, the known position of the aircraft is the first end of the circular arc, called the "theoretical entry point".

Advantageously, the method comprises the displaying of a plot of the portion of the trajectory, by way of viewing means, to the crew of the aircraft.

Advantageously, the theoretical entry point and the exit point of the circular arc are charted with respect:

- to the position of the centre of the circle;
- to the radials which pass respectively through each of these points and are charted with respect to the heading indicating North;
- to the distance from the points to the centre of the arc.

Advantageously, the transition point is charted with respect to the position of the centre of the circle comprising the circular arc, the distance to the centre of the circle, and the length of an arc portion calculated on the basis of the theoretical entry point.

Advantageously, the centre of the circle is a point extracted from a navigation database.

Advantageously, the value of the length of the arc portion calculated between the theoretical entry point and the transition point is proportional to a true speed preset for the aircraft, denoted TAS.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious aspects, all without departing from the invention. Accordingly, the drawings and description thereof are to be regarded as illustrative in nature, and not as restrictive.

BRIEF DESCRIPTION OF THE DRAWINGS

The present invention is illustrated by way of example, and not by limitation, in the figures of the accompanying drawings, wherein elements having the same reference numeral designations represent like elements throughout and wherein.

DETAILED DESCRIPTION OF THE INVENTION

Figure 1:
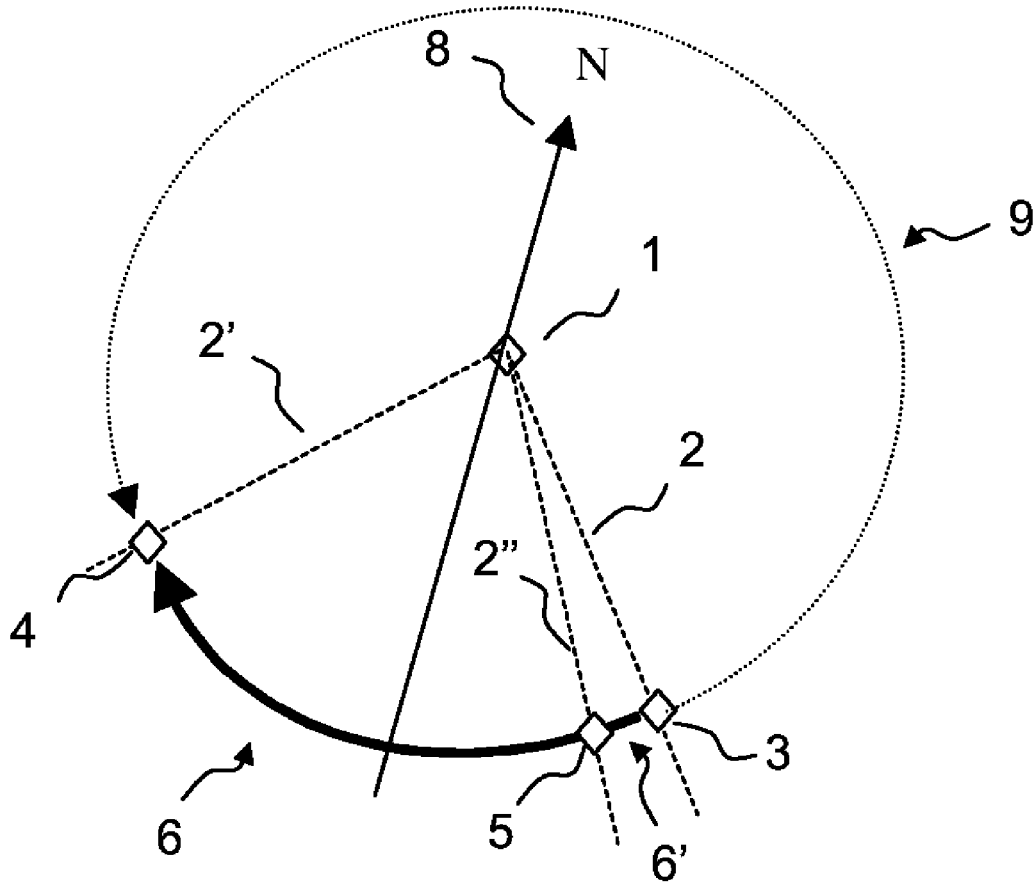
FIG. 1: an exemplary AF leg when the known position of the aircraft in the method is the theoretical entry point.

FIG. 1 presents a diagram of a circular arc 6 generated by the FMS, according to the method of the invention, following the insertion into an input window of the FMS of a certain number of parameters specific to the trajectory to be flown by the aircraft.

The crew wishes the aircraft to fly along a circular arc 6 whose theoretical entry point 3 that is to be approached and whose exit point 4 that is to be attained are not defined in the navigation database. After reaching the exit point 4 after having flown the trajectory portion forming the circular arc, the aircraft will possibly join a predefined flight plan 10 (as will be described in FIG. 2), for example an approach procedure.

In order to generate a circular arc in a simple manner during the flight, the method according to the invention proposes to the crew that the circular arc be defined on the basis of the following parameters:

- The position of the centre of the circle 1, called the "centre of the arc", which is a waypoint generally known to the navigation database of the aircraft. It can correspond to a known beacon but this is not essential, it suffices that it be a waypoint with fixed position, known to the FMS.
- The Value R, generally expressed in Nautical Miles (Nm), corresponding to the radius of the circular arc that one wants to plot and subsequently fly.
- The value of the radial 2, generally expressed in degrees, denoted THETA-entry, from which one wishes theoretically to begin to fly the trajectory portion formed by the circular arc. This value is generally charted with respect to the heading 8 corresponding to North.
- The value of the radial 2', generally expressed in degrees, denoted THETA-exit, at which one wishes to finish flying the trajectory portion formed by the circular arc. This value is generally charted with respect to the heading 8 corresponding to North.
- The direction of the turn, to the right or the left according to the direction from which the aircraft arrives. Depending on the case, the smallest arc 6 or the largest arc 9 in the corresponding circle is considered. The direction of the turn can then be charted by a "right" or "left" turning direction depending on where the aircraft arrives from.
- The default turn direction used to enter the circular arc corresponds to the shortest arc, when the two radials 2, 2' are entered.

The parameters defined above can be transmitted by the air traffic controller or known to the crew, depending on the case.

A case of implementing the method consists in considering an FMS input page, in which a function, named for example "Arc Procedure", makes it possible to input the various aforesaid parameters into a form. The data can then be configured so as to be modifiable at each instant.

In this embodiment the various points are denoted in the display of the FMS as follows:

Theoretical entry point 3: WPT-A
Exit point 4: WPT-B
Centre of the circle 1: WPT-C In a first exemplary case, the FMS makes it possible according to the method of the invention to calculate and to plot, automatically, the trajectory associated with the circular arc and to create the corresponding flight plan. The FMS calculates the plot 6 of the arc on the basis of the data input for each of the points, defined by a name, an angle and a radius:

the theoretical point of entry 3 into the arc WPTA:
Name: WPT-A
Angle: THETA-entry
Radius: R the point of exit 4 from the arc WPTB:
Name: WPT-B
Angle: THETA-exit
Radius: R In this example, a particular case is considered where the aircraft's position chosen for the calculation of the plot is the position of the theoretical entry point 3. This case corresponds to a typical case where the crew wishes only to plot the circular trajectory portion to be traversed so as possibly to join a predefined flight plan 10 (FIG. 2) from the point 4.

Subsequently, another typical case will be considered where the aircraft has an arbitrary position and wishes to plot the trajectory portion corresponding to entry into the circular arc.

In this first example, according to the method of the invention, the FMS calculates the position of a transition point 5 situated at a distance from the theoretical entry point 3 whose value is proportional to a speed preset for the aircraft. This distance is denoted "d" and is generally expressed in Nautical Miles (Nm). Moreover, as the transition point 5 is situated on the arc 6, the distance d therefore corresponds to a portion 6' of the circular arc 6.

The value of the distance "d" is proportional to the speed preset at which the aircraft must fly the trajectory portion formed by the circular arc 6. This speed preset generally corresponds to the theoretical aircraft true speed, it is denoted $TAS_{th}$ and stands for theoretical "true air speed". The speed is divided by a constant C so as to obtain the distance between the theoretical entry point 3 and the transition point 5. An exemplary case makes it possible to advantageously choose the value C=200.

We have the relation $d=TAS_{th}/200$.

In the case of realization described, the transition point 5 positioned on the circular arc 6 at a distance d from the theoretical entry point is denoted WPT-AA in the display of the FMS.

In order to generate the transition point 5, in the same manner as the theoretical entry point 3 (WPT-A) and the exit point 4 (WPT-B), we have the following characteristics which make it possible to define the position of the transition point 5 and to integrate this point into the flight plan:

Name: WPT-AA

Angle: If the arc is "left" (arc 6):

THETA-entrytrue=THETA-entry+deltaTHETA-entry

If the arc is "right" (arc 9):

THETA-entrytrue=THETA-entry−deltaTHETA-entry

With deltaTHETA-entry=360·d/(2πR), expressed in degrees.

Radius: R

In the same manner as previously, the value, denoted THETA-entrytrue, of the radial 2" of the transition point 5, corresponds to the angle onwards of which one wishes actually to begin to fly the trajectory portion formed by the circular arc. This value is generally charted with respect to the heading 8 corresponding to North.

The transition point 5 corresponds to the aircraft's real point of entry into the trajectory portion forming the circular arc 6. The generation of this point makes it possible to adapt, whatever the current trajectory of the aircraft, its entry into the arc portion in a fluid manner.

In the first example, the position of the aircraft being taken at the theoretical entry point 3, the aircraft follows naturally, in this particular case, the circular arc portion 6'.

Subsequent to the construction of the plot of the trajectory portion corresponding to the circular arc 6 and to the construction of the transition point 5, the FMS is capable of generating a flight plan making it possible to connect the theoretical entry point 3 with the exit point 4.

The flight plan is thus created by the succession of events below:

"DISCON", meaning the start of the flight plan corresponding to the plot created;

"IF: WPT-A", IF designating the type of leg, the acronym signifying "Initial Fix";

"DF: WPT-AA", DF signifying "Distance to Fix" at the point WPT-AA, that is to say the radius of the circle (6,9);

"AF", which represents the circular arc between the radial 2" of value THETA-entrytrue passing through the point WPT-AA and the radial 2' of value THETA-exit passing through the point WPT-B.

The arc being plotted at a distance R from the centre WPT-C;

"DISCON", meaning the end of the plot corresponding to the flight plan thus created.

In a second case of realization an arbitrary position of the aircraft in space is considered, said position being known and prior to the theoretical point 3. The method according to the invention makes it possible to plot the trajectory portion corresponding to the trajectory making it possible to join the circular arc and the circular arc portion to be flown.

Figure 2:
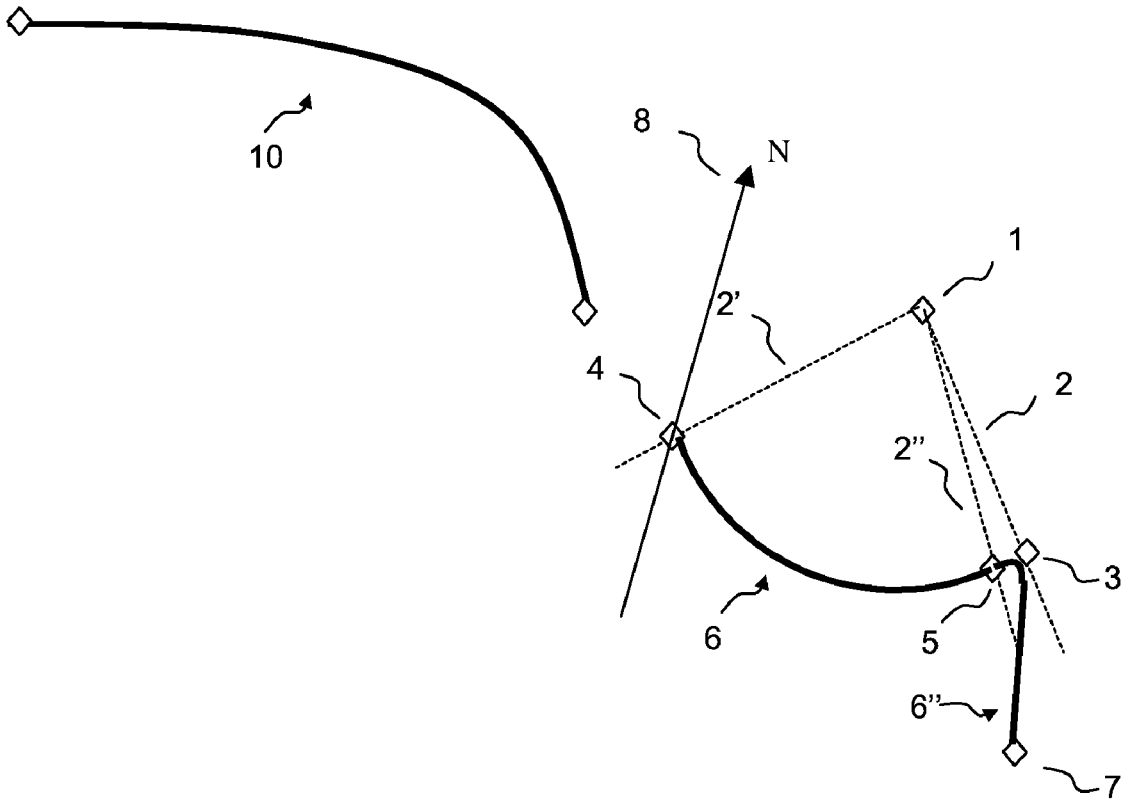
FIG. 2: an exemplary plot of the AF leg when the known position of the aircraft is not on the AF leg.

FIG. 2 illustrates this second exemplary case. A known position 7 of the aircraft is considered. The plot therefore corresponds initially to a first path 6" joining a position 7 of the aircraft to the transition point 5 and subsequently to a second path 6 joining the transition point 5 to the exit point 4. This second part of the plot being calculated as previously.

The plot of the trajectory of the aircraft corresponds to the plot 6" and to the plot 6.

In the case of realization described, the aircraft's position 7 used for plotting the trajectory is denoted WPT-X in the display of the FMS.

The transition point 5 is calculated as previously.

The flight plan is thus created by the succession of the following events displayed in the FMS:

"WPT-X", initial point of the plot, that is to say the aircraft's position known before entry into the generated arc portion;

"DF: WPT-A", DF signifying "distance to fix" at the point WPT-A, that is to say the radius of the circle;

"DF: WPT-AA", DF signifying "distance to fix" at the point WPT-AA, that is to say the radius of the circle;

"AF", represents the arc between the radial 2" THETA-entrytrue at the point WPT-AA and the radial 2' THETA-exit at the point WPT-B. The arc being plotted at a distance R from the centre WPT-C;

"DISCON", meaning the end of the plot corresponding to the flight plan thus created.

The aircraft possibly joins a trajectory 10 corresponding to a flight plan of the FMS, after having flown the trajectory portion corresponding to the plot generated by the method according to the invention.

A variant of the method according to the invention is to consider that it is possible to construct the arc on the basis of parameters other than those mentioned previously.

An example of the parameters to be input by the crew can be:

The position of the centre of the circle 1, called the "centre of the arc", which is a waypoint generally known to the navigation database of the aircraft. It can correspond to a known beacon but this is not essential, it suffices that it be a waypoint with fixed position, known to the FMS.

The value of the radial 2, generally expressed in degrees, denoted THETA-entry, at which one wishes theoretically to begin to fly the trajectory portion formed by the circular arc. This value is generally charted with respect to the heading 8 corresponding to North.

The position of the exit point 4, denoted WPT-B, charted on the basis of a latitude and a longitude;

The direction of the turn, to the right or the left according to the direction from which the aircraft arrives. Depending on the case, the smallest arc 6 or the largest arc 9 in the corresponding circle is considered. The direction of the turn can then be charted by a "right" or "left" turning direction depending on where the aircraft arrives from.

The default turn direction used to enter the circular arc corresponds to the shortest arc, when the two radials 2, 2' are entered.

In the above case, the radius R of the circular arc is calculated as being the distance between the centre 1 of the circle comprising the arc 6 and the exit point 4, the waypoints 3 and 5 being calculated as previously on the basis of the radius R.

The flight plan is created as previously on the basis of:

"IF: WPT-A", IF being the type of leg, the acronym signifying "Initial Fix";

"DF: WPT-AA", DF signifying "distance to fix" at the theoretical entry point 3, that is to say the radius of the circle;

"AF", represents the arc between the radial 2" THETA-entrytrue at the point WPT-AA and the radial 2' THETA-exit at the point WPT-B. The arc being plotted at a distance R from the centre WPT-C;

In all cases, the method according to the invention makes it possible to create a trajectory portion comprising a circular arc with the aid of input parameters identified previously according to the following steps:

A theoretical entry point 3 (WPT-A) is calculated;

An exit point 4 (WPT-B) is calculated;

A circular arc is defined between the theoretical entry point 3 (WPT-A) to the exit point 4 (WPT-B);

A known position of the aircraft 7 (WPT-X) is identified. By default if no point is defined the position of the aircraft is chosen as the theoretical entry point 3 (WPT-A);

A transition point 5 (WPT-AA) situated on the arc is calculated on the basis of a preset for the speed of the aircraft and a constant;

The plots between the known position 7 of the aircraft, the transition point 5 and the exit point 4 make it possible to define the flight plan to be followed, the part of the plot 6 joining the transition point to the exit point being a circular arc.

The main advantage of the invention is that it makes it possible to generate a flight plan that is not predefined in the FMS. The points joining the plot of the flight not being known to the navigation database. It is possible to generate a trajectory portion defining a flight plan that the aircraft flies in an automatic manner. This trajectory portion is defined in a simple manner by knowing a known beacon, an entry point and an exit point that one wishes to attain.

The advantage of such a solution is that the trajectory generated by the method according to the invention is plotted on a viewing window of the FMS.

The method according to the invention makes it possible to gain in terms of availability of the crew when such a procedure is requested by the air traffic control for example. An input window of the FMS makes it possible simply to enter the known parameters and the FMS makes it possible to generate a flight plan simply.

It will be readily seen by one of ordinary skill in the art that the present invention fulfils all of the objects set forth above. After reading the foregoing specification, one of ordinary skill in the art will be able to affect various changes, substitutions of equivalents and various aspects of the invention as broadly disclosed herein. It is therefore intended that the protection granted hereon be limited only by definition contained in the appended claims and equivalents thereof.

The invention claimed is:

1. A method of plotting a trajectory portion for an aircraft crew use, using flight management system of an aircraft, linking a known position of the aircraft to a point in space, denoted the "exit point", comprising the steps of:

defining a circular arc of a circle, a centre of the circle is a point extracted from a navigation database whose coordinates are known, the arc comprising two ends of known coordinates, one end of which is the exit point;

determining a position of a transition point situated on the arc, the transition point being a real point of entry to the circular arc of the trajectory portion by the aircraft, the transition point being charted with respect to the position of the centre of the circle comprising the circular arc, and a length of the arc calculated based on a theoretical entry point;

automatically plotting of the trajectory by the flight management system of the aircraft, and said trajectory successively linking the known position of the aircraft, the transition point and the exit point, wherein the known position of the aircraft is the theoretical entry point which is different from the transition point on the arc.

2. The method according to claim 1, further comprising displaying of a plot of the portion of the trajectory, by way of a viewing device.

3. The method according to claim 1, wherein the theoretical entry point and the exit point of the circular arc are charted with respect:

to the position of the centre of the circle;

to the radials which pass respectively through each of the theoretical entry point and the exit point and are charted with respect to the heading corresponding to North;

to the distance from the theoretical entry point and the exit point to the centre of the arc.

4. The method according to claim 1, wherein a value of the length of the arc portion calculated between the theoretical entry point and the transition point is proportional to a speed preset.

5. The method according to claim 3, wherein a value of the length of the arc calculated between the theoretical entry point and the transition point is proportional to a speed preset.

* * * * *